United States Patent [19]

Iinoya et al.

[11] 3,945,813

[45] Mar. 23, 1976

[54] DUST COLLECTOR

[76] Inventors: Koichi Iinoya, No. 105, Motoyama, Kamigamo, Kita-ku, Kyoto; Kazutaka Makino, No. 954, Ichibancho, Hiyoshidai, Takatsuki, Osaka, both of Japan

[22] Filed: Jan. 16, 1975

[21] Appl. No.: 541,551

Related U.S. Application Data

[63] Continuation-in-part of Ser. No. 240,928, April 4, 1972, abandoned.

[30] Foreign Application Priority Data

| | | |
|---|---|---|
| Apr. 5, 1971 | Japan | 46-20364 |
| June 11, 1971 | Japan | 46-41022 |
| Nov. 4, 1971 | Japan | 46-87121 |
| Nov. 4, 1971 | Japan | 46-87122 |

[52] U.S. Cl. ..... 55/108; 55/123; 55/139; 55/124

[51] Int. Cl.[2] ..... B03C 3/00

[58] Field of Search ..... 55/108, 110, 111, 104, 55/123, 124, 131, 132, 136, 137, 138, 139, 150, 151, 154, 155

[56] References Cited

UNITED STATES PATENTS

| | | | |
|---|---|---|---|
| 2,297,601 | 9/1942 | Williams | 55/132 |
| 2,351,089 | 6/1944 | Abbey | 55/151 |
| 2,490,979 | 12/1949 | Palmer | 55/110 |
| 2,502,560 | 4/1950 | Dahlman | 55/132 |
| 2,589,463 | 3/1952 | Warburton | 55/131 |
| 2,634,818 | 4/1953 | Wintermate | 55/112 |
| 2,847,082 | 8/1958 | Roos | 55/132 |
| 2,917,130 | 12/1959 | Powers | 55/132 |
| 3,040,497 | 6/1962 | Schwab | 55/112 |

OTHER PUBLICATIONS

Masuda et al., "Electrodynamic Behavior of Charged Aerosol Particles in Nonuniform Alternating Fields and its Application in Dust Control". Staub–Reinhaltung der Luft, Vol. 30, No. 11, Nov. 1970, pp. 4–15.

*Primary Examiner*—Bernard Nozick
*Attorney, Agent, or Firm*—Sughrue, Rothwell, Mion, Zinn & Macpeak

[57] ABSTRACT

This invention relates to improvements in and relating to filtering dust collectors.

The improved filtering dust-collector is characterized by the provision of a number of dust-repulsing electrodes which are provided in close proximity to or even embedded within the filter material, said electrodes being adapted for being impressed with a single phase or a multi-phase high A. C. voltage.

3 Claims, 20 Drawing Figures

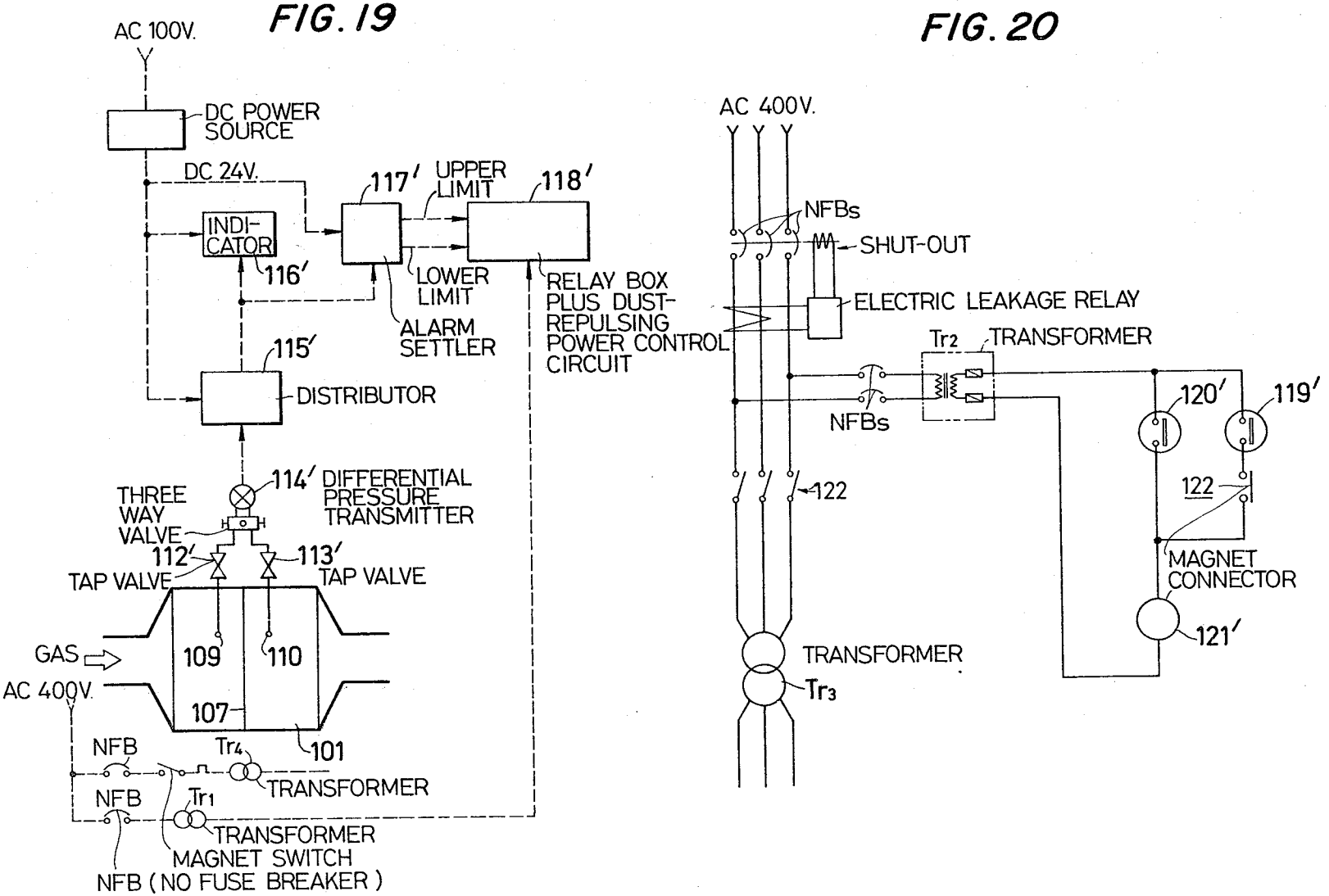
FIG. 20
AC 400V.
NFBs
SHUT-OUT
ELECTRIC LEAKAGE RELAY
TRANSFORMER
Tr2
NFBs
122
TRANSFORMER
Tr3
119'
120'
122
MAGNET CONNECTOR
121'
RELAY BOX PLUS DUST-REPULSING POWER CONTROL CIRCUIT
118'
UPPER LIMIT
LOWER LIMIT
ALARM SETTLER
117'
DISTRIBUTOR
115'
INDI-CATOR
116'
DC 24V.
DC POWER SOURCE
AC 100V.
FIG. 19
DIFFERENTIAL PRESSURE TRANSMITTER
114'
TAP VALVE
113'
THREE WAY VALVE
112'
TAP VALVE
110
109
107
101
TRANSFORMER
Tr4
Tr1
TRANSFORMER
MAGNET SWITCH
NFB (NO FUSE BREAKER)
NFB
NFB
GAS
AC 400V.

DUST COLLECTOR

CROSS-REFERENCE TO RELATED APPLICATION

This application is a continuation-in-part application of our earlier co-pending application Ser. No. 240,928 filed Apr. 4, 1972 now abandoned, by the same inventors which claims priorities from Apr. 5, 1971; June 11, 1971; Nov. 4, 1971 and Nov. 4, 1971 based upon Japanese Pat. Nos. 20364/1971; 41022/1971; 87121/1971 and 87122/1971.

BACKGROUND OF THE INVENTION

This invention relates to improvements in and relating to filtering dust collectors.

Various dust collectors have been proposed and broadly in use especially for the prevention of atmospheric pollution. As an example, mechanical dust collectors such as, for instance, cyclones, venturiscrubbers and the like, and electrical dust collectors utilizing the ionization of the entrained dust particles, and further, bag filters and the like are now broadly being used in various industries for refining of gaseous media such as polluted atmosphere through removal of contained dust particles.

Among others, the filtering dust collector with filter material, preferably in the form of fibrous cloth, fine wire net and the like, is most advantageously utilized on account of its simpler structure, yet for its high operating efficiency, especially for removal of finer dust particles contained in the gaseous medium to be purified. With prolonged operation of such filtering dust collector, the collected dust particles will accumulate on the filtering surfaces of the filter per se, in the form of filter cake, so that the filter pores may be filled up substantially, thus increasing the pressure losses caused thereby. In order to avoid such pressure losses, giving rise to a substantially reduced filtering efficiency, frequent cleaning of the thus filled filter pores must be carried out by application of mechanical blows preferably at regular time intervals. Or alternatively, regular exchange of the filter material by new one must be performed. It is not only costly to execute such filter exchange, but also the filtering operation must be interrupted during such exchange job.

In order to avoid such difficulty, it has already been proposed to strike mechanically the filter material, preferably at regular time intervals for driving the accumulated particles of the filter. As an alternative measure, application of pulsative air streams or air jet streams against the filter is frequently employed for the same purpose in the conventional technique.

It is a common drawback inherent in the conventional techniques above referred to that the filter material is subjected to local severe stresses, as induced therein almost always in the repeated mode, which considerably reduces the durable life of the filter.

It is therefore the main object of the invention to provide a filtering dust collector operative, indeed, without invitation of localized and repeated substantial stresses in the filter material and capable or removing the accumulated dust particles therefrom in an efficient manner for substantial prevention of otherwise possible efficiency reduction of the filter, and indeed, with the benefit of an increased durable life of the filter material.

In order to fulfill the above main object, the improved filtering dust collector is characterized by the provision of a number of dust-repulsing electrodes which are provided in close proximity to or even embedded within the filter material, said electrodes being adapted for being impressed with a single phase or multi-phase high A.C. voltage. According to this invention, the gas streams entraining dust particles and therefore to be refined are passed normally and preliminarily through a nest of a plurality of sets of ionizing electrodes; each one electrode of one of said pairs is electrically connected with a high D.C. voltage source, while the other electrode of each of the electrode pair is earthed, so as to electrically charge or ionize the entrained dust particles. Then, the thus ionizing particles together with the entraining gas streams are passed through the filter material for separating the particles from the streams and depositing substantial part of the thus separated-off particles upon the upstream surface of the filter material. The thus refined gas streams are discharged from the outlet opening of the casing of the dust collector.

With progress of the filtering operation, the quantity of the separated and deposited dust particles will increase and finally they constitute a filter cake on the filter material, and the pressure loss thereat will increase correspondingly, thus the filtering efficiency being decreased correspondingly. For avoiding such disadvantage, the repulsing electrodes are switched on, preferably at properly selected regular time intervals or upon sensing the downstream side pressure drop by a certain predetermined value, so as to impress high A.C. voltage which may be preferably of a multi-phase, most preferably be of the three phase mode, as will be more fully described hereinafter. In this way, the filter cake is separated exclusively electrodynamically for regeneration of the filtering efficiency of the once clogged filtering pores or fine meshes.

After removal of the filter cake, the repulsing electrodes are again switched off.

In the case of the application of a multi-phase, preferably three phase A.C. high voltage energy, the repulsing electrodes are energized with the A.C. phase voltages in the successive order, so as to provide a progressive wave effect to be described.

It should be noted that the ionizing effect on the dust particle as applied during passage of the gas streams through the ionizing nest and as maintained during flow passage from the nest to the mechanical filter is brought about more specifically in such a way that the gas molecules are ionized and will be attached onto the overall surface of the dust particle which acts as if it be an ionized single molecule in its behavior.

Whe occasion desires, the ionizing electrodes nest can be replaced by an electric dust collector unit or units. In this way, coarser particles are caught by the electrostatic precipitator(s), while finer dust particles may be collected at the mechanical filter and then subjected to the electrodynamic repulsion by energization of the repulsing electrodes and upon deposited on the filter material of the mechanical filter.

In a preferred embodiment of the invention, the high A.C. voltage may be applied in the form of pulses.

A preliminary application of about 1,000 – 2,000 A.C. voltage can be, when necessary, applied to the repulsing electrodes, indeed, in advance of the main application of the regular A.C. high voltage thereto under consideration.

When a series of the dust-repulsing electrodes is applied with a single phase A.C. high voltage, an alternating electrical field is established between each two successive members of the electrodes, which field has a maximum buldge-out cross section at the center between these electrodes. Generally-speaking, each of these particles will move along the lines of force in the oscillating mode with the A.C. frequency. Therefore, the particle will be subjected to a combined influence of the thus generated coulomb force and the centrifugal force of different degree as determined by the occasionally occupying position by the particle along the line of force. Since the resultant force appearing in proximity to repulsing electrode is rather intense under substantial influence of the coulomb force, thus being subjected to a rather large repulsing force. On the other hand, at an intermediate point near the center point between the electrodes, the both kinds of the component forces are both effective substantially so that the subjected repulsing and resultant force becomes rather small. Anyhow, by application of a properly selected A.C. high voltage, such as 10,000 – 15,000 volts, as an example, the deposited filter cake can be removed effectively from the filter material overcoming the influence of the gas flows under treatment and the cohesive force among the particles constituting the cake. As was referred to hereinbefore, the filter material can perform the separation of the fouling dust particles from the gaseous medium and the electrical field may take charge of the prevention of formation of filter cake on the filter per se.

As was referred to, the single phase A.C. high voltage as impressed upon the repulsing electrodes can be used in the form of pulse voltages. In this way, the most predominant parts of the A.C. voltage energy can be utilized in an accentuated manner, so as to improve the operating efficiency so far.

When applied the dust-repulsing electrodes with a properly selected multi-phase A.C. voltage, a transmission force directing in the filter surface direction can be established; such force can be defined as the progressive wave effect.

This and further objects, features and advantages of the invention will become more apparent when read the following detailed description of the invention by reference to the accompanying drawings illustrative of several preferred embodiments of the invention.

BRIEF DESCRIPTION OF THE DRAWINGS

In the drawings:

FIG. 19 is a schematic diagram of a whole arrangement of important constituents of the dust collector system according to this invention having as its main working part, said filter assembly proper.

FIG. 20 is a schematic diagraphm showing electrical circuitry for the system of FIG. 19.

DETAILED DESCRIPTION OF THE INVENTION

Figure 1:
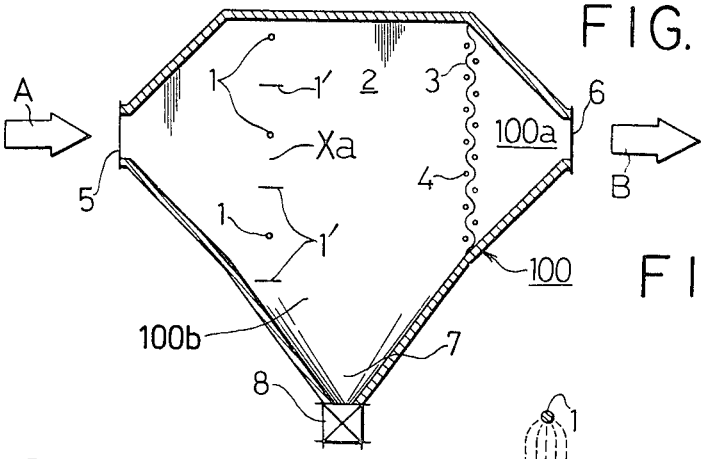
FIG. 1 is a schematic sectional side view of a first embodiment of the filter assembly proper employable in the present invention.
Figure 2:
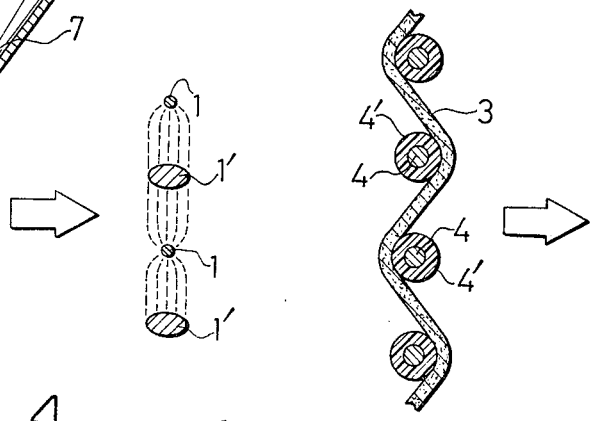
FIG. 2 is a schematic enlarged view of a part of FIG. 1.

Referring now to FIGS. 1 and 2 of the accompanying drawings, the first embodiment of the filter assembly proper employable in this invention will be described hereinunder in detail.

Numeral 100 represents a tight and rigid casing of the system according to this invention, having an inlet opening 5 and an outlet opening 6, only schematically shown. An arrow "A" denotes the direction of a flow-in gas stream which must be subjected to a dust-collecting action during passage through this casing 100. Second arrow "A" represents the flow direction of the refined gas stream outgoing from the casing 100 through outlet opening 6.

Pairs of ionizing bar electrodes 1 and 1′ are suspended within the interior space of said casing and at a certain distance from said inlet opening 5 by properly insulated suspension means, although not shown; these means may be constituted by suspension bars or supporting bars insulatedly attached to the wall(s) of said casing 100. The suspension, preferably of the upper series electrodes 1, may be made from the ceiling wall of the casing, and the supporting, preferably of the lower series electrodes 1′, may be made from the lower wall of the casing and in the form of supporting struts, again properly insulated although not shown.

Or alternatively, the bar electrodes 1 and 1′ may be supported at their both ends attached fixedly and insulatedly to the front and rear walls of the casing 100. The rear wall only is shown at **100*b*, while the front wall is not shown. In this case, these electrodes are substantially in the form of bridge beams. When necessary, the number of electrodes may be increased to a substantial degree, for effecting the ionizing action in a satisfactory manner. These electrodes 1 and 1' are electrically connected with the both electrodes of a D.C. high voltage source, although not shown. By the provision of these ionizing electrodes 1, 1', substantially upstream half part of the interior space 2 of the casing 100** can act as an ionizing space.

Inwardly apart a certain distance from the outlet opening 6, there is provided a filtering screen 3 which may consist of a cloth nylon, glass fiber, asbestos or the like and fixed at its periphery to the walls of casing 100, so as to cross the flow passage of the gases to be refined. This filtering material may consist of a fibrous mat, cloth or the like dielectric material, The cloth or mat 3 may be coated with a specifically selected coating of filtering material. A vertical row of dust-repulsing bar electrodes 4 arranged in a horizontal and parallel lines; each of these bar electrodes 4 may be encased in an insulator sheath 4', the both ends thereof being fixedly supported by the front and rear casing-walls. The provision of these insulator sheaths serves for interrupting direct contact of dust particles entrained by the gas streams, with the electrodes 4. The filtering cloth or mat 3 is threaded in a zig-zag way in contact of the sheaths 4' as shown.

Although not shown, the outlet opening 6 is connected through a duct, not shown, with the inlet of an exhausting blower or the like suctioning machine.

The casing 100 is formed at its lower part with a hopper-like section 7 which is fitted at its lowermost part with a discharge valve unit 8.

Figure 3:
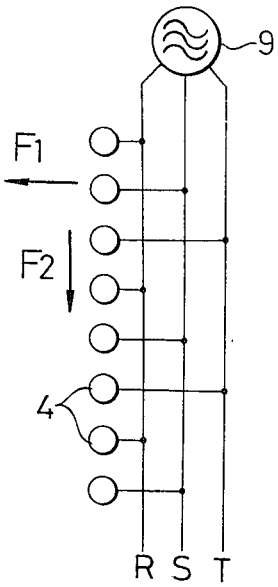
FIG. 3 is a schematic electrical wiring diagram of a three phase A.C. voltage source system together with the repulsing electrodes as employed in FIGS. 1 – 2.

As shown schematically in FIG. 3, these electrodes 4 are electrically connected successively with the three phase lines "R", "T" and "S" of a high voltage three phase A.C. supply system 9.

Separately from or in addition to said exhausting blower, a delivery blower may be connected through a proper duct to the inlet opening 5 of the casing 100, if necessary.

The operation of the apparatus so far shown and described is as follows:

Dust containing gas stream is led through the inlet opening 5 into the interior space 2 of the casing 100 upon energization of one or both said blowers, not shown. The electrodes 1 act as discharge electrodes and may be electrically connected with a d.c. high voltage source, as referred to. The opposite electrode 1' may be earthed when necessary. When more than a pair of these ionizing electrodes are provided, as in the present case, there are formed alternately as discharge and earth electrodes.

While passing of the introduced gas stream through each pair of the discharge or high voltage-impressed electrode and the earthed electrode, the contained dust particles are charged electrically and arrive upon passing through the ionizing space at the filtering section containing the filter material 3 by which the gas stream is separated of the dust particles. The thus purified gas stream will be delivered from the outlet opening 6.

With progress of the purifying operation, the separated dust particles will accumulate upon the inside surface of the filtering material 3, thus representing a gradually increased flow resistance to the passing-through gas stream. When this flow resistance attains at a certain predetermined value, these electrodes 4 are connected manually or automatically by opening a certain switching means, not shown, with the three phase conductors "R", "S" and "T" of the A.C. supply system 9, as was referred to hereinbefore briefly.

By impressing these electrodes 4 with phase currents successively, the accumulated dust particles are repulsed off from the filter material 3 by the electrodynamic forces thus invited and the pressure drop will be recovered to a certain value intrincic to the filter in its clean state. When the pressure drop is thus recovered, a certain conventional control means, not shown, is actuated and voltage impression to the electrodes 4 is terminated. As the control means, it may comprise a conventional fluid pressure responsive device which is arranged in the down-stream part of the filter and electrode unit 3, 4 and 4' and senses pressure drop in the downstream space 100a in front of the filter material 3, although not shown.

The electrodynamically repulsed-off dust particles from the filter material 3 will be accumulated in the hopper section 7 and then discharged therefrom by opening the discharge valve 8.

When the electric connection of the repulsing electrodes 4 with the three phase A.C. supply system is made as in the way shown in FIG. 3, the charged dust particles will be subjected to an electrodynamic repulsing force $F_1$ caused by the A.C. field as well as a transportation force $F_2$ by the progressive waves, in addition to the inherent gravity force (refer to Masuda, et al, "Staub-Reinhalt, Luft" Vol. 30, No. 11, November, 1970). Therefore, these particles are driven to move downwards by the combined action of these influencing forces.

Figure 4:
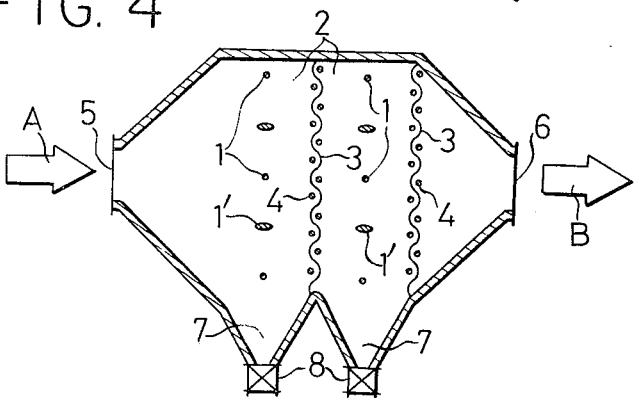
FIG. 4 is a similar view of FIG. 1 illustrating, however, a modified embodiment from the foregoing first embodiment shown therein.

FIG. 4 shows a modification of the foregoing, In this variation, the filter means are arranged in two successive stages. The first or upstream stages is designed and arranged to catch coarser particles and the second or downstream stage is designed and arranged to catch finer particles. In this case, the filter material of the first stage has naturally coarser pores or meshes than those of the second stage filter cloth or mat. Since the first and second stages perform similar function, the respective same reference numerals are used for easy comparison. If necessary, the number of the filtering stages can be increased to three or still more numerous.

In the foregoing embodiments, the electrically charged dust particles contained in a gaseous medium are filtered off and the gradually accumulated mass of the thus separated particles on the filter is repulsed off therefrom electrodynamically by application of A.C. voltage(s) to the repulsing-off electrodes 4 as was described hereinbefore; and thus there is no mechanical vibration or impulses to be encountered and indeed, without any stoppage of the filtering action. Therefore, it will be seen that the dust-collecting operation and the accumulated dust particles drive-off opertion can be performed simultaneously, which represents, indeed, a remarkable progress in the art.

As an example, with use of a conventional bag filter, the apparent filtering speed could not be accelerated to higher than 2 cm/sec or so. But, on the contrary, with use of the foregoing inventive dust filter apparatus embodying the novel principles of the invention, it was determined by our practical experiments that the filtering speed can be increased to 10 and several times to 50 times of the conventional velocity; thus, it can be increased to 30 cm/sec – 1 m/sec which represents a remarkable value beyond the common sense of any person skilled in the art.

In the foregoing embodiments, the electrically repulsing electrodes 4 are covered with respective insulator sheaths 4' so that when the charged particles are brought into contact only with these sheaths, thus not with the electrodes per se. By employing this means, the charged dust particles can not loose their electrical charge and can be maintained their charged conditions for a long time. Thus, upon lapse of occasionally very long period in their accumulated and cohesive state on the filter material, they can be subjected to the electrodynamic separating forces. In addition, it should be noted that even conductive particles can be treated equally and successfully.

When desired, the repulsing electrodes can be divided into two groups one of which can be fed with a three phase A.C. voltage, while the remaining one can be charged with a single phase A.C. voltage.

Figure 5:
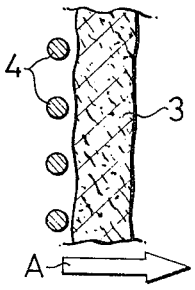
FIGS. 5 – 7 represent respective sectional and partial views, illustrative of three different mutual arrangements of the repulsing electrodes and a filter material cooperating therewith.
Figure 6:
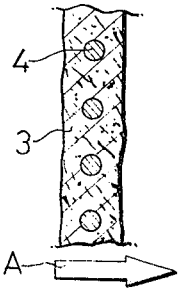
Figure 7:
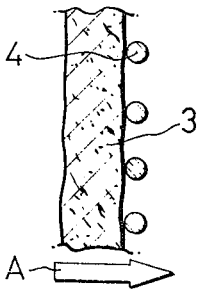

In FIGS. 5 – 7, three modified arrangements of the dust particle-repulsing electrodes 4 relative to the filter material 3 are shown. In FIG. 5, the electrodes 4 are arranged behind the filter material 3 at a certain short distance. In FIG. 6, these electrodes 3 are completely embedded in the filter material. In FIG. 7, the electrodes 4 are arranged directly in front of the filter material 3.

Figure 8:
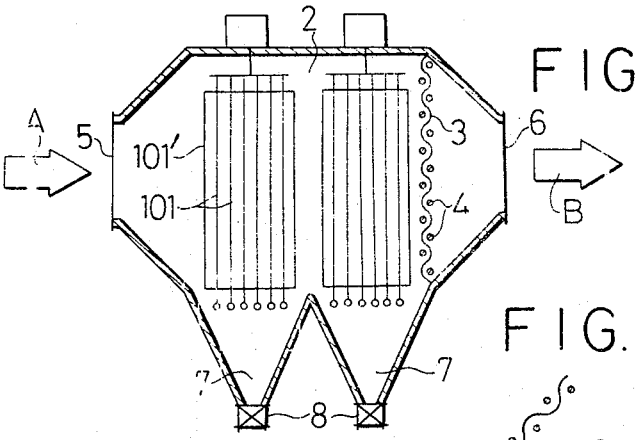
FIG. 8 is a similar view of FIG. 1, illustrative, however a still further modified embodiment from that shown in FIG. 4.

In the still further modified embodiment shown in FIG. 8, the electrodes 1, 1' have been dispensed with, and a group of discharge electrodes in the form of wire or bar electrodes 101 are arranged in two successive stages and in corresponding groups, while two plate-like formed dust-collecting electrodes 101' are arranged in respective and opposite arrangement to these discharge electrodes as in the conventional electrostatic precipitators. The discharge electrodes 101 are electrically connected through proper leads, not shown, to the positive side of a high voltage D.C. voltage source, while the plate electrodes 101' are earthed, although not shown. Suspension means for these electrodes 101 and 101' have been omitted from the drawing by virtue of their very popularity.

When gas stream is passed through these electrostatic precipitators, coarser dust particles only may be collected as conventionally, while finer and electrically charged particles may be conveyed and filtered off by the filter material 3 as before and effectively repulsed off electrodynamically by the energization of the electrodes 4 as before, upon once accumulation on the inside surface of the filtering material.

As conventionally, the dust-collecting electrodes 101' are arranged to be subjected to mechanical striking forces periodically as known per se to let the accumulated particles separated therefrom and drop downwards to the respective discharge valves 8, through respective hoppers 7. In this case, once collected finer particles having particle sizes of several microns or lesser will escape therefrom by being re-entrained by the flowing through gas streams. In the present modification, however, these finer particles can be effectively caught by the filtering and electrodynamically repulsing unit 3; 4 as will be apparent from the foregoing disclosure set forth in connection with FIGS. 1 – 7.

Figure 9:
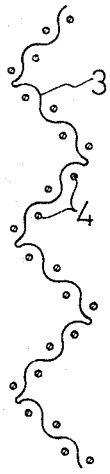
FIG. 9 is a schematic, sectional and partial view of a filter material and repulsing electrodes combination as a modification from the corresponding part of the foregoing embodiments, designed and arranged to provide a larger filtering area than the foregoing.

In FIG. 9, a modified arrangement of the unit 3; 4 is shown. In this case, the filter material 3 is arranged in a vertical zig-zag way, for increasing the overall filtering area. Correspondingly, the arrangement is modified so as to represent a zig-zag arrangement as a whole and in close proximity to the filter material 3.

Figure 10:
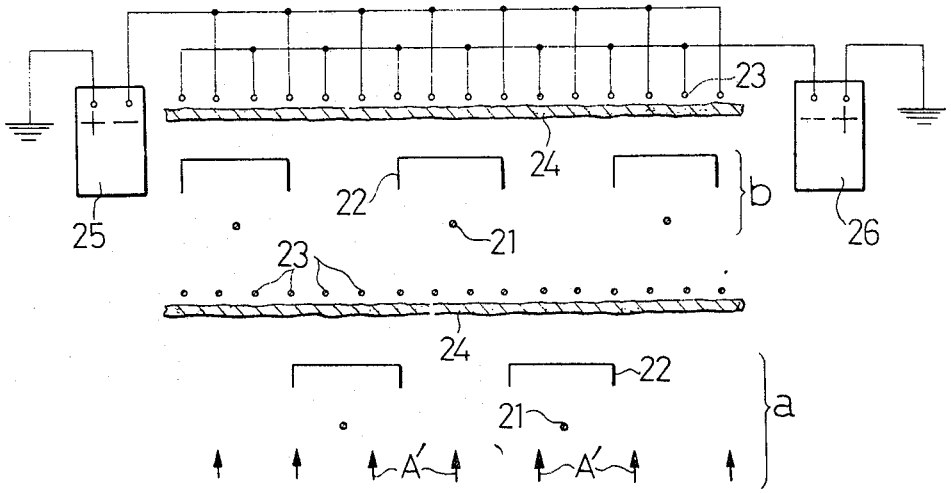
FIG. 10 is a similar view of FIG. 1 and shows a schematic and sectional view of a second embodiment of the invention.

In FIG. 10, a second embodiment is shown. In this embodiment, the housing of the device being omitted only for convenience, a series of parallel arrows A' represents the general direction of the gas stream to be refined. Numeral 21 represents schematically several discharge electrodes arranged at a properly selected mutual distance and in horizontal rows. Dust-collecting electrodes 22 are arranged in a vertical correspondence with respective discharge electrodes 21. Although only schematically represented, each of these dish-shaped electrodes 22 has at its peripheral edge a flange-like projection directing against the gas inlet direction, although the inlet opening has been omitted from the drawing only for simplicity. Mutual effective distance between each two electrodes 22 is selected to be practically equal to the effective horizontal width of the electrode 22. Naturally, the number of the electrodes 21 and 22 is shown by way of example and may be increased to any suitable number and rows, although not shown. These dust-collecting electrodes 22 are arranged in apparently horizontal rows as shown. Each vertical pair of the electrodes 21 and 22 constitutes a dust-collecting unit *a* or *b*.

The upper three dust-collecting unit *b* are arranged in a downstream stage. The first stage units *a* are arranged in a staggered way relative to the second stage units *b*. Numeral 24 represents two oppositely and parallel arranged filter cloths or mats, similar to those denoted 3 in the foregoing embodiment. Each of these filter 24 is positioned at a certain downstream distance from the respective dust-collecting unit *a* or *b*, and covers the whole cross-sectional area of the flow passage of the gas stream.

A series of dust-repulsing electrodes 23 is arranged directly behind the respective filter material 24, these electrodes 23 being of the similar nature so far as their electrical function with that of the electrodes as shown at 4 in the foregoing. These electrodes 23 can be embedded within the filter material 24, similarly as shown in FIG. 6.

Numerals 5 and 6 represent similar pulse-generators, the negative poles thereof being connected electrically with the upper electrodes 23 in an alternate way, while the positive pole of these pulse generators are earthed as shown.

Although not shown, the lower electrodes 23 are similarly connected with these pulse generators.

Upon feeding of an electrical pulse, each pair of electrodes 22 and 23 will generate an electrical field.

When a foulded gaseous medium will be delivered from a blower or the like gas delivery machine, not shown, through the inlet opening, not shown, the contained dust-particles of coarser sizes are collected by the collector electrodes 22 by collision thereagainst.

The finer dust particles which have not been caught by the dust-collecting electrodes 22, yet having been electrocharged during passage through the units *a*, will be caught by the filter cloths or fine mesh nets 24 which particles have been entrained by the upwardly (FIG. 10) flowing gas streams, and then deposited on the lower surface of these mechanical filters 24 while they are kept in their electrically charged conditions. When these filtered-off and deposited particles have been accumulated to a certain substantial degree and the thus invited pressure loss downstreams of these mechanical filters is sensed and an information signal thereof is utilized to start an electric controller, not shown, so as to close an electrical switch, attached to each of the pulse generators 25 and 26 which are only schematically represented by virtue of their very popularity. In this way, the high voltage pulse generators 25 and 26 are connected in circuit, and the dustrepulsing electrodes 23 are impressed with high voltage pulses from the generators. As seen, these electrodes 23 are connected alternately with the generators 25 and 26. In this way, between the duct-collecting electrodes 24, on the one hand, and the repulsing electrodes 23, on the other hand, pulsative electrical fields will be intermittently established, so as to provide corresponding impulsive forces onto the accumulated dust particles on the filters 24. It should be noted that the electric connection relative to the lower filter 24 has been omitted from the drawing only for the simplicity thereof. In this way, the accumulated particles are intermittently driven off from the respective mechanical filters 24 in a shaper and stronger manner than otherwise where sinusoidal A.C. high voltage waves are applied to the repulsing electrodes 23.

With use of the two separate pulse generators 25 and 26, two groups of the repulsing electrodes 23 can be alternately fed with the high voltage pulse impulses, thereby increasing substantially the desired drive-off effect upon the accumulated particles being realized. In the embodiment shown in FIG. 10, the mechanical filter 24 in combination with repulsing electrodes 23 is positioned downstream of each of the first and second stage dust collector units *a* and *b*. However, if necessary, this filter 24 together with its attributed dust-repulsing electrodes 23 can be positioned downstream of the second stage dust collector units *b* only.

Figure 15:
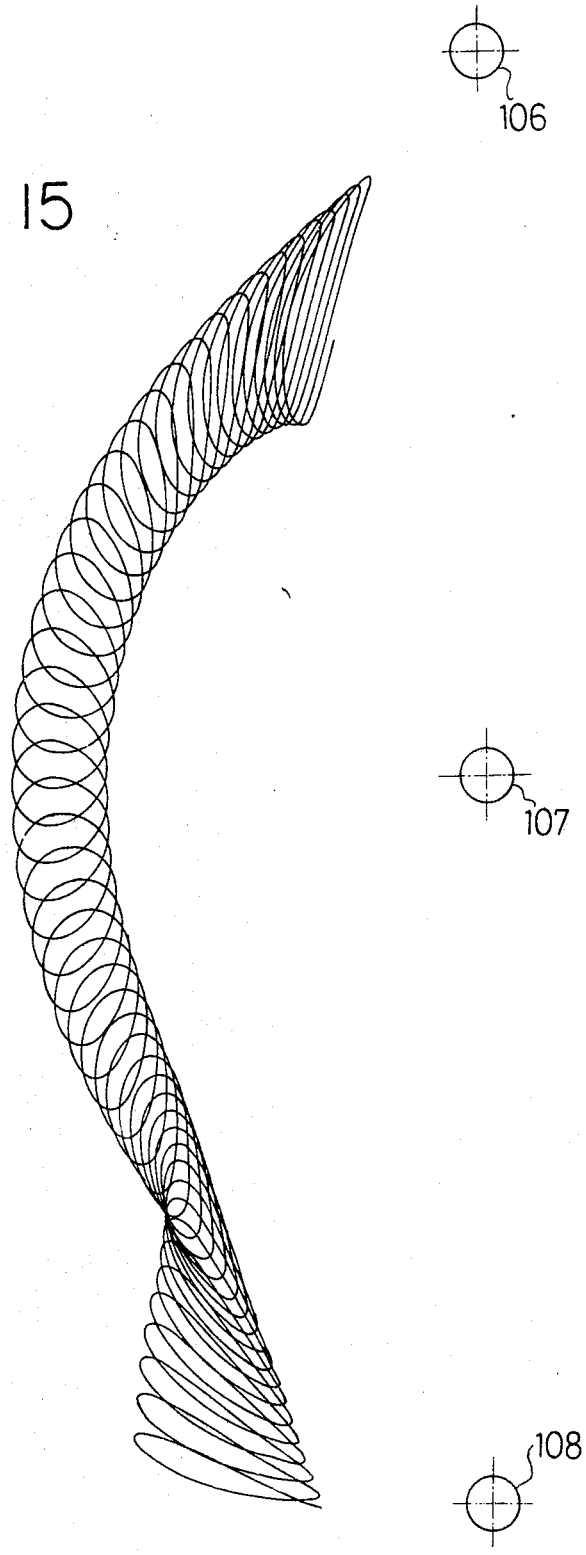

FIG. 15 represents a schema of the electrode, by way of example, of a dust particle when subjected to a single phase A.C. high voltage electrical field as appeared by energization of a series of repulsing electrodes, represented representatively a pair of such electrodes 104 and 105.

In this case, the centrode of the particle is shown in an ideal way that the electrode pair is not influenced by the presence of still further neighboring electrodes of the same kind. This manner of idealization will be applied to the cases shown in FIGS. 14 and 15, respectively.

Figure 14:
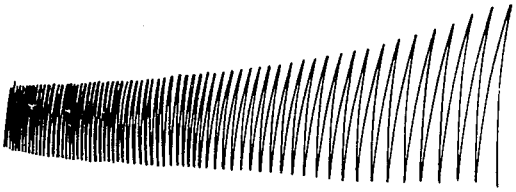
Figure 14:
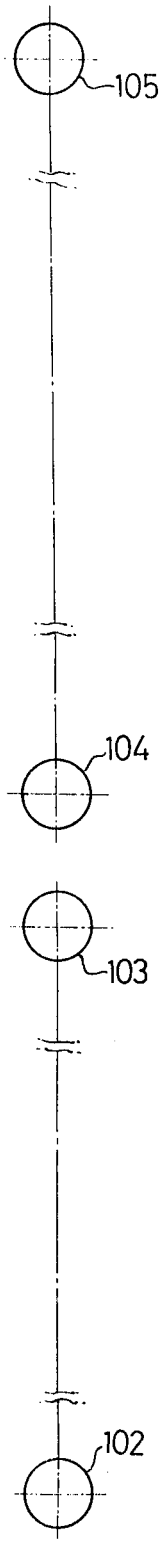

In the case of FIG. 14, the repusling electrodes 102 and 103 are energized with a pulsative single phase A.C. higher voltage.

Figure 16:
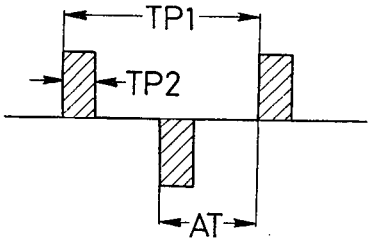
FIG. 16 is a schematic model of a single phase A.C. and pulsative high voltage which is usable in the invention.

In the case of FIG. 16, the electrodes 106–108 are unergized with a three phase A.C. high voltage.

Figure 13:
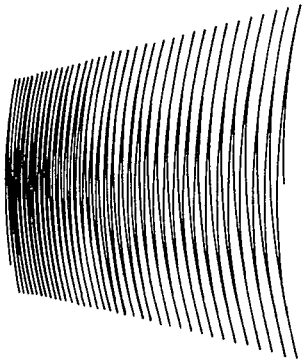
FIGS. 13 – 15 represent three different diagrams of the ideal centrode of a particle when subjected to the action of a single phase A.C. high voltage field, an A.C. high pulse voltage field and a three phase A.C. high voltage field, respectively.

From these schematic representations shown in FIGS. 13-15, a repulsing force directing from right to left substantially horizontally is applied electrodynamically to the respective dust particle. These are naturally symbolized and schematic representations and in practice there may be collisions among dust particles and the like will naturally occur.

But, it is definitely believed that the generation of the main electrodynamic repulsing force can be easily understood. The detailed experimental conditions can be well seen from the following Table.

Table

| No. | Symbol | Experimental Data | M.K.S.-units | Three phase AC | Single phase AC | Single Phase AC Pulses |
|---|---|---|---|---|---|---|
| 1. | PL | Mutual electrode distance | (m) | $1.0 \times 10^{-2}$ | $1.0 \times 10^{-2}$ | $1.0 \times 10^{-2}$ |
| 2. | R | Radius of electrode | (m) | $1.0 \times 10^{-10}$ | $0.5 \times 10^{-3}$ | $1.0 \times 10^{-10}$ |
| 3. | X1 | Initial value along X axis | (m) | $-0.6 \times 10^{-2}$ | $0.5 \times 10^{-2}$ | $0.5 \times 10^{-2}$ |
| 4. | Y1 | Initial value along Y axis | (m) | $0.2 \times 10^{-2}$ | $0.2 \times 10^{-2}$ | $0.2 \times 10^{-2}$ |
| 5. | N | Position of nil electric potential | (m) | $1.0 \times 10^{-1}$ | $1.0 \times 10^{-1}$ | $1.0 \times 10^{-1}$ |
| 6. | V1 | Pulse peak (elect. 1) | (v) | $4.0 \times 10^{3}$ | $1.0 \times 10^{3}$ | $1.0 \times 10^{4}$ |
| 7. | V2 | Pulse peak (elect 2) | (v) | | | $1.0 \times 10^{4}$ |
| 8. | Q | Particle charge | (coulomb) | $5.0 \times 10^{-14}$ | $5.0 \times 10^{-14}$ | $5.0 \times 10^{-14}$ |
| 9. | H | Time scale unit | (sec) | $1.0 \times 10^{-4}$ | $1.0 \times 10^{-4}$ | $1.0 \times 10^{-4}$ |
| 10. | AT | Time lag between V1 and V2 | (sec) | | | $2.0 \times 10^{-3}$ |
| 11. | TP1 | Period of Pulse | (sec) | | | $4.0 \times 10^{-3}$ |
| 12. | TP2 | Length of pulse | (sec) | | | $1.0 \times 10^{-3}$ |
| 13. | ET | Coefficient of viscosity | (n.sec/m²) | $1.83 \times 10^{-5}$ | $1.83 \times 10^{-5}$ | $1.83 \times 10^{-5}$ |
| 14. | D | Yad. of particle | (m) | $1.4 \times 10^{-5}$ | $1.4 \times 10^{-5}$ | $1.4 \times 10^{-5}$ |
| 15. | M | Mass of particle | (kg) | $1.5 \times 10^{-12}$ | $1.5 \times 10^{-12}$ | $1.5 \times 10^{-12}$ |

$= 4 \times 10^{3}$ sm2 ft
f=50 cycles

As seen from the foregoing, the dust-collecting electrodes 22 positively as known per se are positioned substantially in opposition to a series of the dust-repulsing electrodes 23 which are negatively charged thereby such a possibility being given as to increase the electrical working efficiency of the whole arrangement and to minimize the occupying space thereof.

Figure 11:
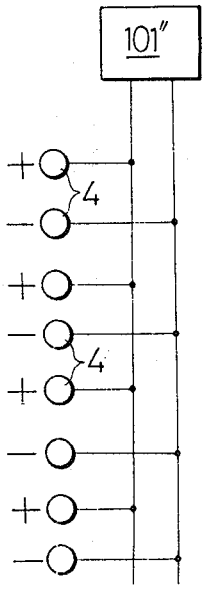
FIG. 11 is a schematic representation of an electrical wiring diagram showing a high voltage supply source and a series of repulsing electrodes.
Figure 12:
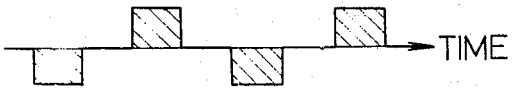
FIG. 12 is a voltage wave diagram showing the pulsative A.C. voltage as supplied in the case of the arrangement shown in FIG. 11.

In FIG. 11, a wiring connection of the high voltage A.C. source with the dust-repulsing electrodes 4 as employable in the foregoing several embodiments shown in FIGS. 1 – 9 is shown. In this figure, 101'' denotes a high voltage pulse generator of known structure and capable of delivery of a series of A.C. pulses as shown in FIG. 12. By consulting the foregoing description, its functional operation will be self-explanatory without effecting further detailed analysis.

The nature of the invention highly adapted for generation of electrodynamic repulsing force in the aforementioned way may be understood by reference to the schematic explanatory views, FIGS. 13 – 16, by consultation with the following Table.

Figure 17:
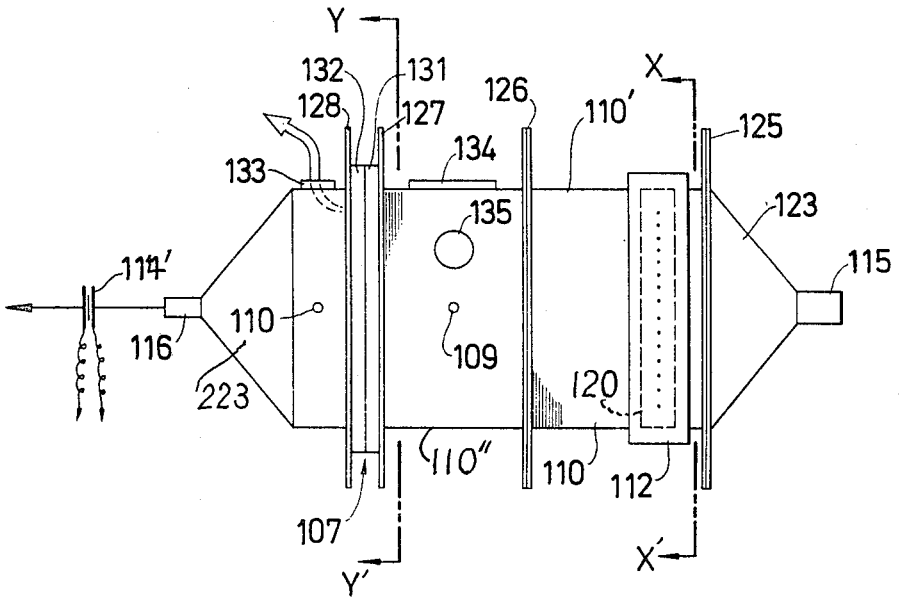
FIG. 17 is a side view of a more specific experimental filter assembly proper wherein however, the hopper section(s) and discharge valve(s) have beenn omitted.
Figure 18:
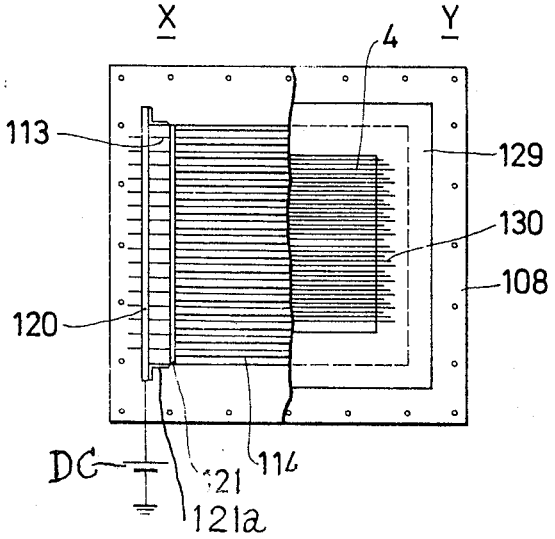
FIG. 18 is a schematic combined front view of two groups of charging and repulsing electrodes employable in the foregoing assembly shown in FIG. 17, when seen at X - X′ and Y - Y′ shown therein, respectively.

In FIGS. 17 and 18, numeral 110 represents a casing or housing, as at 100 in FIG. 1, having preferably a square cross-section and a gas inlet opening 115 and outlet opening 116, in the similar way as at 5 and 6 in FIG. 1, respectively. In an imaginary vertical plane at a predetermined distance from said inlet opening 115, there is provided a nest of wire electrodes, more specifically discharge electrodes 113 and earthed electrodes 114 arranged alternatively with each other, as at 1 and 1' in FIG. 1. Discharge electrodes 113 are tightly tensioned between and fixedly attached to a pair of holding frames 120 only one of which is shown in FIG. 18. These holding frames are attached fixedly and insulatingly to the right-hand half housing element 110', although the fixing and insulating means have been omitted from the drawing. The discharge electrodes 113 are electrically connected, through said frame 120 acting as a bus bar, to the positive side of a high voltage D.C. source DC, while the negative side thereof is earthed as shown.

The opposite wire electrodes 114 are fixedly supported at their respective both ends 121 by a pair of supporting frames which are supported fixedly in turn through insulator means 121*a* by the first mentioned frames 120. In FIG. 18, only one of said supporting frames 112, made of metal is shown. The opposite wire electrodes 114 are earthed through proper conductor means not shown.

The housing element 110′ in which the charging zone is established and maintained, is flanged at 125 to the inlet housing element 123 of a cone shape. In the similar way, the housing element 110′ is flanged at 126 to the left-hand side housing element 110′′ in which the filtering and electro-repulsing zone to be described is formed and maintained. Thus, the element 110′ can be independently removed from the housing assembly 110 and together with the charging and ionizing electrodes nest.

Numerals 135 represents only schematically a hand hole; 139 a glass-covered viewing window; and 109 a position through which a pressure take-out upstream gas pressure can be taken out for automatic measurement at an automatic pressure recorder to be described.

The housing element 110′′ is provided at its outer end with a flange 127 kept in detachable connection with a mating flange 128 formed at the inner end of an outlet housing element 223 formed into a hollow cone having said gas outlet 116 at its appex.

Filter-mounting plate 131 and a supporting frame 132 are attached to said flanges 127 and 128, respectively. The plate 131 mounts fixedly a mechanical filter 129 shown in FIG. 18 which may be similar to that shown only schematically at 3 in FIGS. 1 and 2.

Dust-repulsing wire electrodes 130 are tightly tensioned on the frame 128 so as to be positioned at a close proximity to the mechanical filter 129, preferably at its downstream side as shown. For showing substantial similarity to those shown in FIG. 1, the same reference numeral 4 is additionally and auxiliarilly shown also in FIG. 18. In the present embodiment, however, these dust-repulsing electrodes are arranged in a vertical plane. These electrodes are connected respectively with phase lines R′, S′ and T′ in a successive order as was descrived more specifically in connection with FIG. 3, of an A.C.-400 volt-power source which is shown only schematically in FIG. 20.

Numeral 133, FIG. 17, shows only schematically an opening or socket for introducing these phase leads from outside into the interior space of the end housing element 223, and indeed, through a step-up transformer Tr3 which elevates the phase currents from 400 to 1,000–3,000 volts, as an example.

Now referring to FIGS. 19 and 20, gaseous upstream and downstream fluids relative to the filtering and dust-repulsing zone 107 comprising said mechanical filter 129 and dust-repulsing electrodes 130 are taken out from respective gas taps 109 and 110 from the respective zones of the interior of housing assebmly 110 and conveyed into a differential pressure transmitter 114′ wherein the pressure differential is converted into a corresponding D.C. voltage. Part thereof is conveyed through a distributor 115′ to an indicator 116′ for visual display purpose. When a predetermined higher limit of the pressure differential signal reaches at the relay box 118′, a certain relay included therein is energized to close its relay contact 119′, thereby magnet connector 88A being actuated for closing contacts at 88. In this way, high A.C. voltages are applied through transformer Tr3 to dust-repulsing electrodes 4 or 130.

When a predetermined lower limit signal reaches at relay box 118′, another relay contact 120′ is closed and the former relay contact 119′ is closed and the former relay contact 119′ is opened so that another magnet contactor 121 is actuated to open the contacts 122. Thus, high voltage feed to the dust-repulsing electrodes is interrupted.

The embodiments of the invention in which an exclusive property or privilege is claimed are as follows:

1. A combined dust-collector and filter assembly wherein a stationary, regid and hollow casing is provided for defining a passage having an inlet and an outlet opening positioned at opposite sides of said casing for the receiption of a dust-containing gas stream and for the discharge of a refined gas stream after passage through the interior space of said casing, respectively, a plurality of ionizing stationary electrodes are provided in proximity to said inlet opening for ionizing dust particles contained in the said inlet stream, a mechanical filter disposed across said entire passage for filtering off said ionized dust particles from said inlet gas stream flowing through said filter, a plurality of dust-repulsing electrodes are positioned in close proximity to or within the material of said filter and a voltage source for applying multi-phase A.C. high voltage to said electrodes each time for short duration of time for electrodynamically driving separated and accumulated dust particles in the form of a filter cake deposited in and on said filter, off the filter, a hopper formed at the bottom of said casing for collecting the electrodynamically drivenoff dust particles, and a dust-discharge valve positioned in said hopper.

2. A combined dust-collector and filter assembly as set forth in claim 1 wherein said dust-repulsing electrodes are imbedded in said filter.

3. A combined dust collector and filter assembly comprising a stationary, rigid, hollow casing defining a passage having an inlet and an outlet opening positioned at opposite ends of said casing for the reception of a dust contining gas stream and for the discharge of a refined gas stream after passage through the interior space of said casing respectively, a plurality of ionizing stationary electrodes mounted in said casing in proximity to said inlet opening for ionizing dust particles contained in said inlet stream, a mechanical filter disposed in said casing across said entire passage for filtering off said ionized dust particles from said inlet gas stream flowing through said filter, a plurality of dust-repulsing electrodes covered with respective insulator sheaths mounted in said casing in close proximity to the material of said filter and a voltage source for applying a.c. voltage to said electrodes periodically for a short duration of time for electrodynamically driving dust particles which have accumulated on said filter off said filter, a hopper formed at the bottom of said casing for collecting the driven-off dust particles and a dust discharge valve positioned in said hopper.

* * * * *